US009286849B2

(12) United States Patent
Tatara

(10) Patent No.: US 9,286,849 B2
(45) Date of Patent: Mar. 15, 2016

(54) DISPLAY UNIT, METHOD OF DRIVING THE SAME, AND ELECTRONIC APPARATUS

(71) Applicant: Sony Corporation, Tokyo (JP)

(72) Inventor: Satoshi Tatara, Tokyo (JP)

(73) Assignee: JOLED INC., Tokyo (JP)

( * ) Notice: Subject to any disclaimer, the term of this patent is extended or adjusted under 35 U.S.C. 154(b) by 59 days.

(21) Appl. No.: 14/174,950

(22) Filed: Feb. 7, 2014

(65) Prior Publication Data

US 2014/0232703 A1 Aug. 21, 2014

(30) Foreign Application Priority Data

Feb. 20, 2013 (JP) ..... 2013-031375

(51) Int. Cl.
*G09G 3/36* (2006.01)
*G09G 3/32* (2006.01)

(52) U.S. Cl.
CPC ..... *G09G 3/3677* (2013.01); *G09G 3/3233* (2013.01); *G09G 2300/0852* (2013.01); *G09G 2300/0861* (2013.01)

(58) Field of Classification Search
CPC ..... G09G 3/3677; G09G 3/3233
See application file for complete search history.

(56) References Cited

U.S. PATENT DOCUMENTS

2005/0122289 A1* 6/2005 Yamazaki et al. ..... 345/77
2009/0046041 A1* 2/2009 Tanikame ..... 345/76
2010/0033476 A1* 2/2010 Yamamoto et al. ..... 345/214

FOREIGN PATENT DOCUMENTS

JP 2010-266490 11/2010

* cited by examiner

*Primary Examiner* — Shaheda Abdin
(74) *Attorney, Agent, or Firm* — Dentons US LLP

(57) ABSTRACT

A display unit includes: a pixel array section configured of pixels arranged in a matrix form, each of the pixels including an electro-optical device, a drive transistor, and a write transistor, the drive transistor configured to drive the electro-optical device, and the write transistor connected between a signal line and a gate electrode of the drive transistor and configured of a plurality of transistor devices connected to one another in series; and a drive circuit section configured to drive each of the pixels of the pixel array section, in which a potential of an intermediate node between two transistor devices selected from the plurality of transistor devices configuring the write transistor is turned to an intermediate potential between a potential of the signal line and a potential of the gate electrode of the drive transistor after completion of signal writing by the write transistor.

8 Claims, 12 Drawing Sheets

DISPLAY UNIT, METHOD OF DRIVING THE SAME, AND ELECTRONIC APPARATUS

CROSS REFERENCE TO RELATED APPLICATIONS

This application claims the benefit of Japanese Priority Patent Application JP 2013-031375 filed Feb. 20, 2013, the entire contents which are incorporated herein by reference.

BACKGROUND

The present technology relates to a display unit, a method of driving the same, and an electronic apparatus, and more specifically the present technology relates to a display unit, a method of driving the same, and an electronic apparatus each of which is capable of ensuring reliability of a screen.

Organic EL (Electro-Luminescence) display units, liquid crystal displays (LCDs), plasma display panels (PDPs), and the like are widely known as flat panel display units.

In a pixel circuit including a transistor formed with use of an oxide semiconductor in some of the organic EL display units, a drive transistor or a write transistor has a multi-gate configuration in which two or more transistor devices are connected to each other in series (for example, refer to Japanese Unexamined Patent Application Publication No. 2010-266490).

In a case where current supply capability of channel width and channel length equivalent to that in a single-gate configuration is provided by using a transistor with a multi-gate configuration in a pixel circuit formed with use of an oxide semiconductor, a region where oxygen desorption occurs is allowed to be narrowed to reduce oxygen desorption from a channel material. Moreover, in the pixel circuit using the transistor with the multi-gate configuration, inappropriate pixel operation upon threshold value correction or mobility correction that may possibly occur in a pixel circuit using a transistor with a single-gate configuration is allowed to be eliminated.

SUMMARY

However, in a case where a write transistor has a multi-gate configuration, for example, a double-gate configuration in which two transistor devices are connected to each other in series, specifically, in a light emission period, a large reverse bias is applied to a transistor device located closer to a drive transistor of the transistors configuring the write transistor. Therefore, a threshold voltage of the transistor device is shifted (reduced) to a depression side, and a gate voltage that is supposed to be off is turned on, and as a result, reliability of a screen may be compromised.

Therefore, it is desirable to ensure reliability of the screen.

According to an embodiment of the present technology, there is provided a display unit including: a pixel array section configured of pixels arranged in a matrix form, each of the pixels including an electro-optical device, a drive transistor, and a write transistor, the drive transistor configured to drive the electro-optical device, and the write transistor connected between a signal line and a gate electrode of the drive transistor and configured of a plurality of transistor devices connected to one another in series; and a drive circuit section configured to drive each of the pixels of the pixel array section, in which a potential of an intermediate node between two transistor devices selected from the plurality of transistor devices configuring the write transistor is turned to an intermediate potential between a potential of the signal line and a potential of the gate electrode of the drive transistor after completion of signal writing by the write transistor.

Each of the pixels may include a switch configured to write the intermediate potential to the intermediate node of the write transistor, and the drive circuit section may turn the switch on after the completion of the signal writing by the write transistor.

Each of the pixels may further include a switching transistor configured to control supply of a drive current of the electro-optical device by the drive transistor, and the drive circuit section may turn the switch on simultaneously with when turning the switching transistor on.

The intermediate potential may be lower than a potential of the gate electrode of the drive transistor during light emission from the electro-optical device.

The intermediate potential may be higher than a potential obtained by subtracting a threshold voltage of a transistor device located closer to the signal line than the intermediate node selected from the plurality of transistor devices configuring the write transistor from a potential of a scanning line of the write transistor when the write transistor is off.

The intermediate node may be located at a connection point between a transistor device located closest to the drive transistor and another transistor device selected from the plurality of transistor devices configuring the write transistor.

According to an embodiment of the present technology, there is provided a method of driving a display unit, the method including: preparing, in the display unit, a pixel array section and a drive circuit section, the pixel array section configured of pixels arranged in a matrix form, each of the pixels including an electro-optical device, a drive transistor, and a write transistor, the drive transistor configured to drive the electro-optical device, the write transistor connected between a signal line and a gate electrode of the drive transistor and configured of a plurality of transistor devices connected to one another in series, and the drive circuit section configured to drive each of the pixels of the pixel array section; and turning a potential of an intermediate node between two transistor devices selected from the plurality of transistor devices configuring the write transistor to an intermediate potential between a potential of the signal line and a potential of the gate electrode of the drive transistor after completion of signal writing by the write transistor.

According to an embodiment of the present technology, there is provided an electronic apparatus provided with a display unit, the display unit including: a pixel array section configured of pixels arranged in a matrix form, each of the pixels including an electro-optical device, a drive transistor, and a write transistor, the drive transistor configured to drive the electro-optical device, and the write transistor connected between a signal line and a gate electrode of the drive transistor and configured of a plurality of transistor devices connected to one another in series; and a drive circuit section configured to drive each of the pixels of the pixel array section, in which a potential of an intermediate node between two transistor devices selected from the plurality of transistor devices configuring the write transistor is turned to an intermediate potential between a potential of the signal line and a potential of the gate electrode of the drive transistor after completion of signal writing by the write transistor.

In the embodiments of the present technology, the potential of the intermediate node between two transistor devices selected from the plurality of transistor devices configuring the write transistor is turned to the intermediate potential between the potential of the signal line and the potential of the gate electrode of the drive transistor after completion of signal writing by the write transistor.

In the embodiments of the present technology, reliability of a screen is allowed to be ensured.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the technology, and are incorporated in and constitute a part of this specification. The drawings illustrate embodiments and, together with the specification, serve to explain the principles of the technology.

DETAILED DESCRIPTION

Some embodiments of the present technology will be described below referring to the accompanying drawings.

(Configuration Example of Display Unit)

Figure 1:
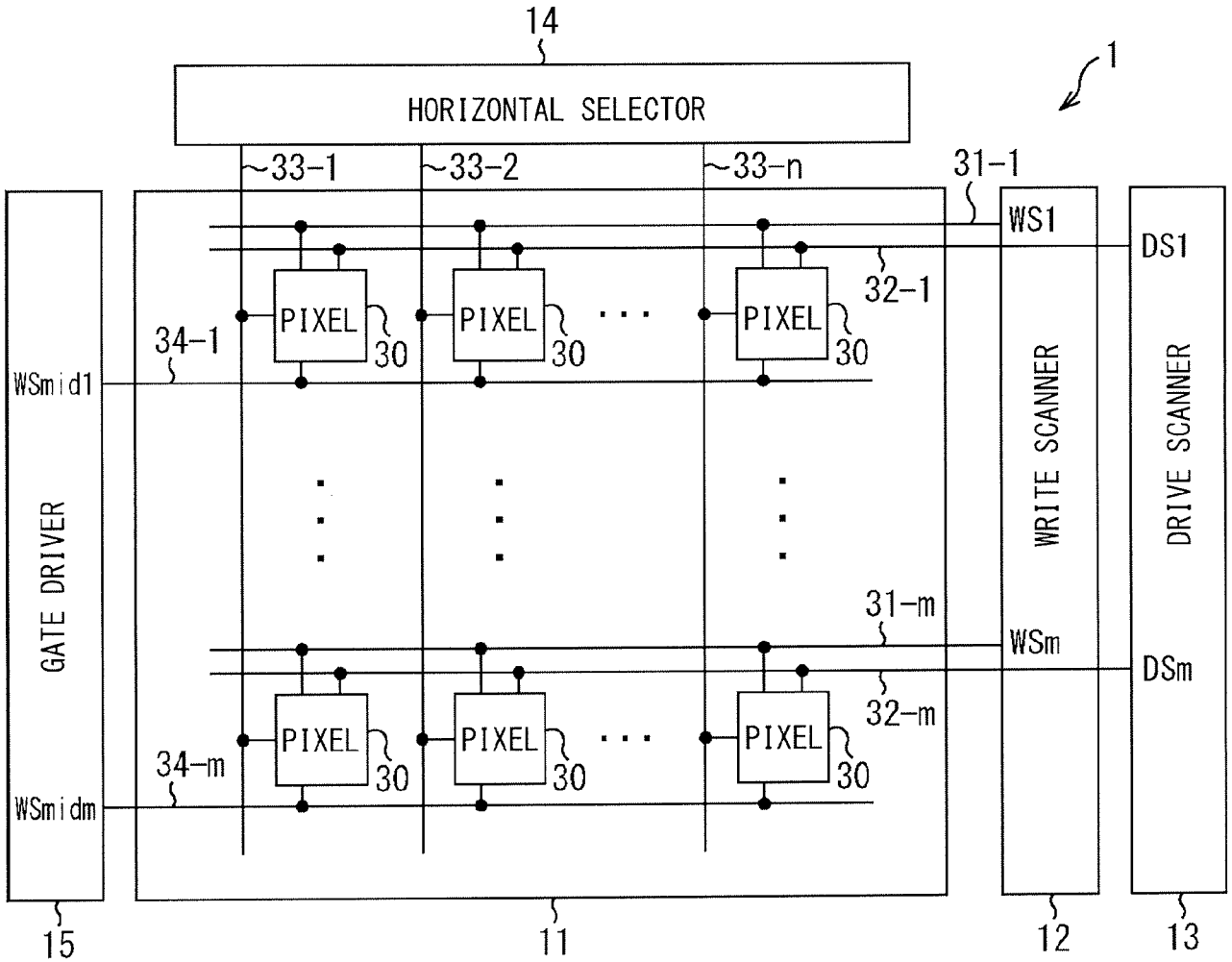
FIG. 1 is a block diagram illustrating an active matrix display unit according to an embodiment of the present technology.

FIG. 1 is a block diagram illustrating an active matrix display unit according to an embodiment of the present technology.

The active matrix display unit may be a display unit configured to control a current flowing through an electro-optical device by an active device, for example, an insulated gate field effect transistor disposed in a pixel including the electro-optical device. For example, as the insulated gate field effect transistor, a thin film transistor (TFT) may be used.

A configuration of an active matrix organic EL display unit using, as a light-emitting device of a pixel (a pixel circuit), an organic EL device that is a current-driven electro-optical device configured to vary light emission luminance with a current value will be described as an example below.

As illustrated in FIG. 1, an organic EL display unit 1 according to the embodiment of the present technology includes a pixel array section 11, a write scanner 12, a drive scanner 13, a horizontal selector 14, and a gate driver 15.

The pixel array section 11 is configured of a plurality of pixels 30 that each include an organic EL device and are two-dimensionally arranged in a matrix form, and components from the write scanner 12 to the gate driver 15 function as a drive circuit section configured to drive the pixels 30 of the pixel array section 11.

In a case where the organic EL display unit 1 is capable of color display, one pixel (a unit pixel) as a unit configured to form a color image is configured of a plurality of sub-pixels, and the respective sub-pixels correspond to the respective pixels 30 in FIG. 1. More specifically, in a display unit capable of color display, one pixel may be configured of, for example, three sub-pixels, i.e., a sub-pixel emitting red (R) light, a sub-pixel emitting green (G) light, and a sub-pixel emitting blue (B) light.

However, one pixel is not necessarily configured of a combination of sub-pixels of three colors RGB, and may be configured by adding a sub-pixel of one color or sub-pixels of a plurality of colors to the sub-pixels of the three colors. More specifically, to improve luminance, one pixel may be configured by adding a sub-pixel emitting white (W) light to the sub-pixels of the three colors, or to expand a color reproduction range, one pixel may be configured by adding one or more sub-pixels emitting complementary color light to the sub-pixels of the three colors.

In the pixel array section 11, scanning lines 31-1 to **31-*m* and power supply lines 32-1 to 32-*m* are wired to respective pixel rows along a row direction (a pixel arrangement direction of a pixel row) in a matrix with m rows and n columns of the pixels 30. Moreover, signal lines 33-1 to 33-*n* are wired to respective pixel columns along a column direction (a pixel arrangement direction of a pixel column) in the matrix with the m rows and the n columns of the pixels 30**.

The scanning lines 31-1 to **31-*m* are connected to respective output ends of corresponding rows of the write scanner 12. The power supply lines 32-1 to 32-*m* are connected to respective output ends of corresponding rows of the drive scanner 13. The signal lines 33-1 to 33-*n* are connected to respective output ends of corresponding columns of the horizontal selector 14**.

Moreover, in the pixel array section 11, scanning lines 34-1 to **34-*m* are wired to respective pixel rows along the row direction in the matrix with the m rows and n columns of the pixels 40**.

The scanning lines 34-1 to **34-*m* are connected to respective output ends of corresponding rows of the gate driver 15**.

The pixel array section 11 is typically formed on a transparent insulating substrate such as a glass substrate. Accordingly, the organic EL display unit 1 has a flat panel configuration. A pixel circuit of each of the pixels 30 of the pixel array section 11 may be formed with use of an amorphous silicon TFT or a low-temperature polysilicon TFT. In a case where the low-temperature polysilicon TFT is used, the write scanner 12, the drive scanner 13, the horizontal selector 14, and the gate driver 15 may be also mounted on a display panel (a substrate) where the pixel array section 11 is formed.

The write scanner 12 is configured of a shift register circuit or the like that sequentially shifts (transfers) start pulses in synchronization with clock pulses. The write scanner 12 sequentially (line-sequentially) scans the pixels 30 of the pixel array section 11 from one row to another by sequentially supplying write scanning signals WS1 to WSm (hereinafter simply referred to as "write scanning signals WS") to the scanning lines 31-1 to **31-*m* (hereinafter simply referred to as "scanning lines 31"), respectively, in writing of a signal voltage of an image signal to each of the pixels 30 of the pixel array section 11**.

The drive scanner 13 is configured of a shift register circuit or the like that sequentially shifts start pulses in synchronization with clock pulses. The drive scanner 13 supplies power supply potentials DS1 to DSm (hereinafter simply referred to as "power supply potentials DS") that are switchable between a first power supply potential Vcc and a second power supply potential Vini lower than the first power supply potential Vcc to the power supply lines 32-1 to **32-*m* (hereinafter simply referred to as "power supply lines 32"), respectively, in synchronization with line-sequential scanning by the write scanner 12**. Control of emission and non-emission of light is performed by switching of the power supply potentials DS between the first power supply potential Vcc and the second power supply potential Vini.

The horizontal selector 14 selectively outputs a signal voltage Vsig of an image signal corresponding to luminance information and a reference voltage Vofs supplied from a signal supply source (not illustrated). The reference voltage Vofs is a potential as a reference of the signal voltage Vsig of the image signal (for example, a potential corresponding to a black level of the image signal), and is used for threshold value correction that will be described later.

The signal voltage Vsig and the reference voltage Vofs output from the horizontal selector 14 are written to the respective pixels 30 of the pixel array section 11 through the signal lines 33-1 to **33-*n* (hereinafter simply referred to as "signal lines 33") on a basis of pixel rows selected by scanning by the write scanner 12. In other words, the horizontal selector 14** takes a line-sequential writing drive form in which the signal voltage Vsig is written from one row to another.

The gate driver 15 sequentially scans (line-sequentially scans) the respective pixels 30 of the pixel array section 11 by sequentially supplying scanning signals WSmid1 to WSmidm (hereinafter simply referred to as "scanning signals WSmid") to the scanning lines 34-1 to **34-*m* (hereinafter simply referred to as "scanning lines 34**"), respectively.

(Configuration Example of Pixel Circuit)

Figure 2:
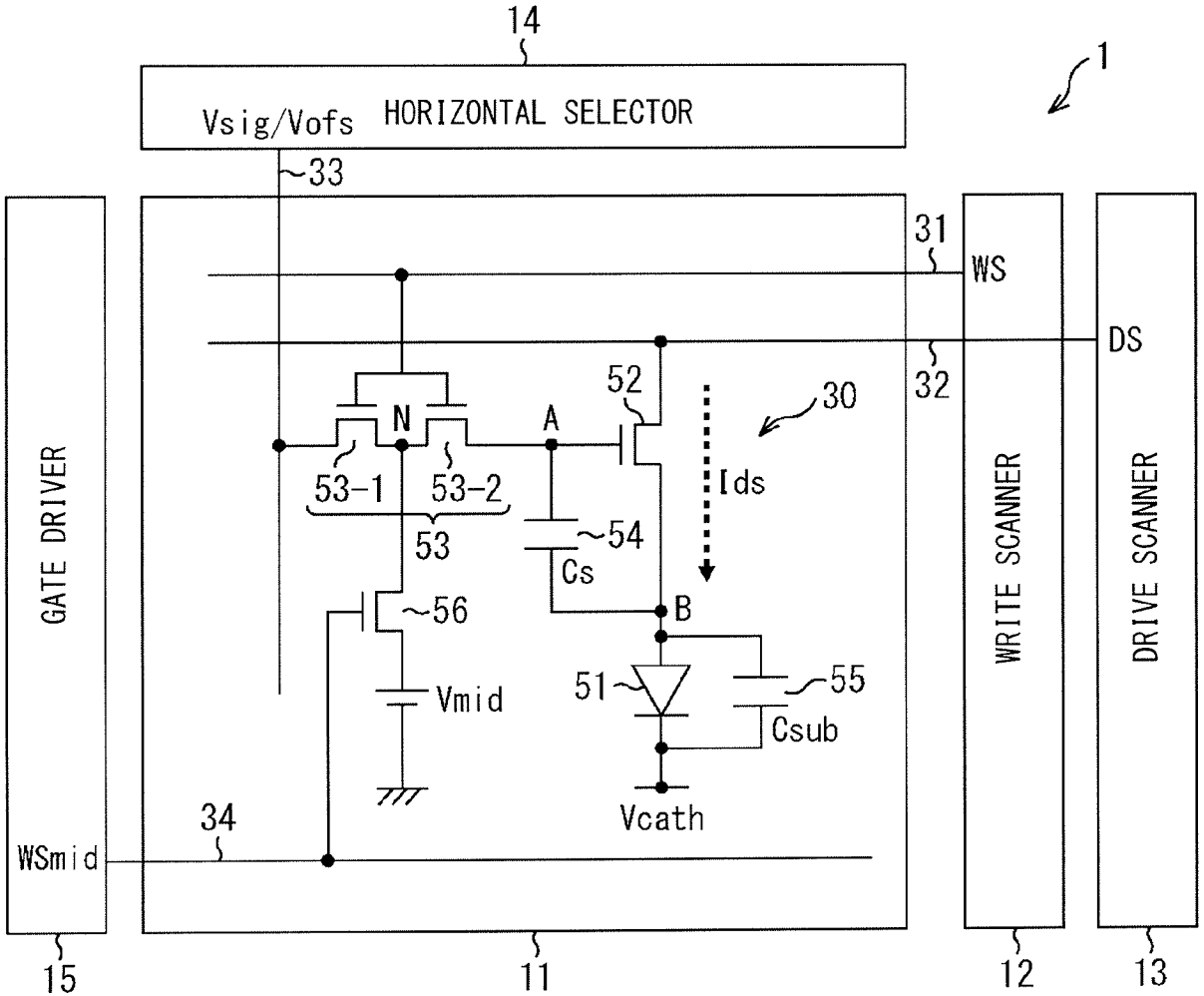
FIG. 2 is a diagram illustrating a configuration example of a pixel circuit.

FIG. 2 illustrates a specific configuration example of the pixel (pixel circuit) 30. A light emission section of the pixel 30 is configured of an organic EL device 51 that is a current-driven electro-optical device configured to vary light emission luminance with a current value.

As illustrated in FIG. 2, each of the pixels 30 is configured of the organic EL device 51 and a drive circuit that drives the organic EL device 51 by applying a current to the organic EL device 51.

A cathode electrode of the organic EL device 51 is connected to a common power supply line that is wired common to all of the pixels 30 (so-called solid wiring).

The drive circuit that drives the organic EL device 51 is configured of a drive transistor 52, a write transistor 53, a retention capacitor 54, an auxiliary capacitor 55, and a switching transistor 56. As the drive transistor 52, the write transistor 53, and the switching transistor 56, N-channel type TFTs are used. It is to be noted that a combination of transistors of this electrical conduction type is merely an example, and a combination of transistors are not limited thereto. Moreover, a connection relationship between the transistors, the retention capacitor, the organic EL device, and the like is not limited to a connection relationship that will be described later.

In the drive transistor 52, one electrode (of a source electrode and a drain electrode) is connected to an anode electrode of the organic EL device 51, and the other electrode (of the source electrode and the drain electrode) is connected to the power supply line 32.

The write transistor 53 has a so-called double-gate configuration in which two transistor devices 53-1 and 53-2 are connected to each other in series. In the transistor device 53-1, one electrode (of a source electrode and a drain electrode) is connected to the signal line 33, and the other electrode (of the source electrode and the drain electrode) is connected to one electrode (of a source electrode and a drain electrode) of the transistor device 53-2. In the transistor device 53-2, the other electrode (of the source electrode and the drain electrode) is connected to a gate electrode of the drive transistor 52. Moreover, a gate electrode of the write transistor 53 is connected to the scanning line 31.

It is to be noted that a connection point between the transistor device 53-1 and the transistor device 53-2 in the write transistor 53 is hereinafter referred to as "intermediate node N".

In the retention capacitor 54, one electrode is connected to a gate electrode of the drive transistor 52, and the other electrode is connected to the other electrode of the drive transistor 52 and an anode electrode of the organic EL device 51.

In the auxiliary capacitor 55, one electrode is connected to the anode electrode of the organic EL device 51, and the other electrode is connected to the common power supply line. The auxiliary capacitor 55 is provided to serve as an auxiliary to equivalent capacity of the organic EL device 51 so as to compensate for a shortage of the equivalent capacity, thereby enhancing a write gain of an image signal with respect to the retention capacitor 54.

It is to be noted that, in FIG. 2, the other electrode of the auxiliary capacitor 55 is connected to the common power supply line; however, the connection point of the other electrode is not limited to the common power supply line, and may be a node of a fixed potential. When the other electrode of the auxiliary capacitor 55 is connected to the node of the fixed potential, compensation for a shortage of the capacity of the organic EL device 51 is allowed to be made, and the write gain of the image signal with respect to the retention capacitor 54 is allowed to be enhanced.

In the switching transistor 56, one electrode (of a source electrode and a drain electrode) is connected to the intermediate node N of the write transistor 53, and the other electrode (of the source electrode and the drain electrode) is connected to a predetermined potential Dmid. Moreover, a gate electrode of the switching transistor 56 is connected to the scanning line 34.

In each of the drive transistor 52, the write transistor 53 (the transistor devices 53-1 and 53-2), and the switching transistor 56, the one electrode is a metal wiring line electrically connected to a source region or a drain region, and the other electrode is a metal wiring line electrically connected to the drain region or the source region. Moreover, depending on a potential relationship between the one electrode and the other electrode, the one electrode may serve as the source electrode or the drain electrode, and the other electrode may serve as the drain electrode or the source electrode.

(Operation of Pixel Circuit)

Next, an operation of the pixel circuit 30 of the organic EL display unit 1 will be described below referring to a timing chart in FIG. 3.

Figure 3:
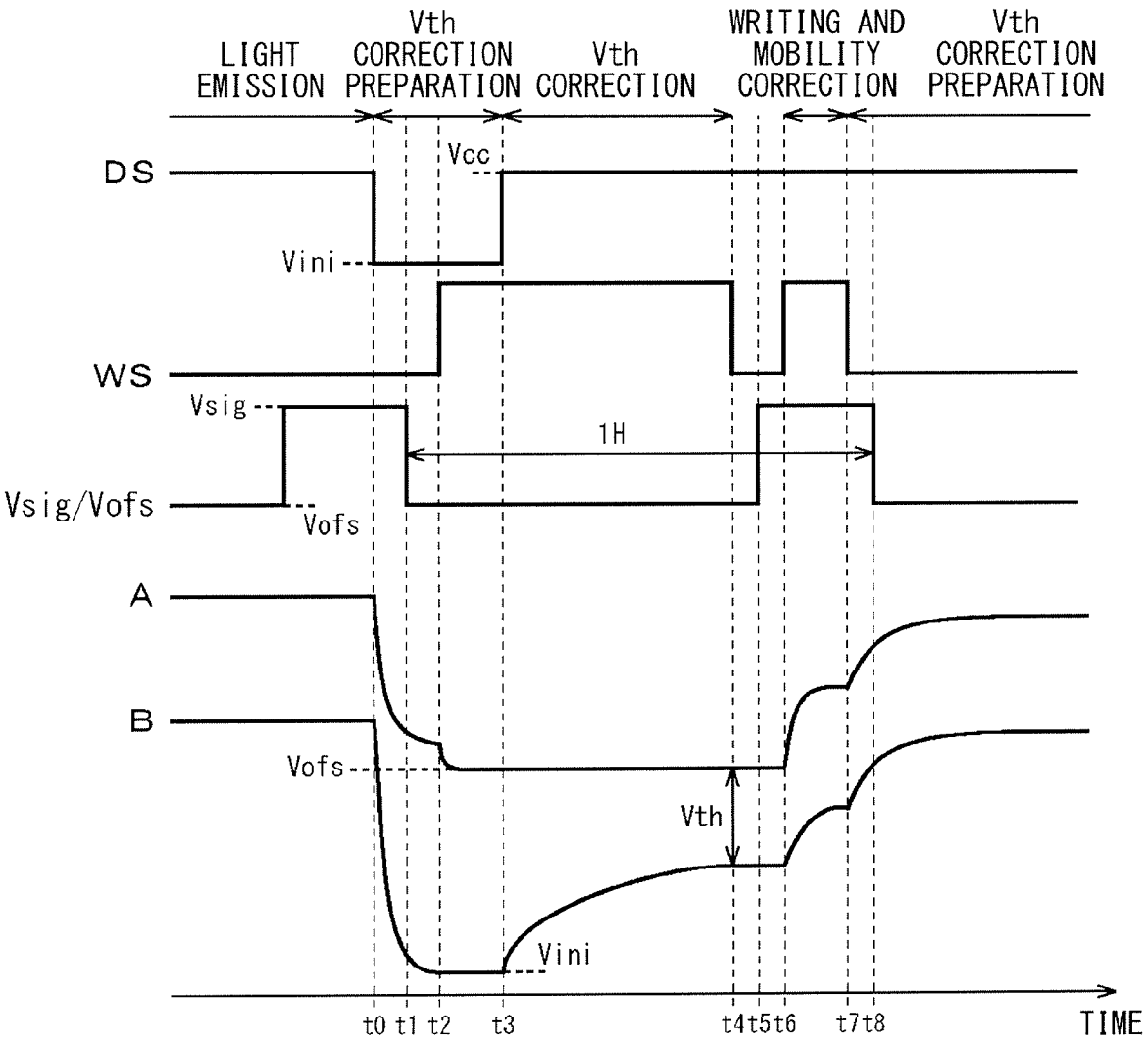
FIG. 3 is a timing chart for describing an operation of the pixel circuit.

The timing chart in FIG. 3 illustrates variations in a potential (power supply potential) DS of the power supply line 32, a potential (write scanning signal) WS of the scanning line 31, a potential (Vsig/Vofs) of the signal line 33, and an A-point (a gate potential of the drive transistor 52) and a B-point (a source potential of the drive transistor 52) in the pixel circuit 30 in FIG. 2.

In FIG. 3, a period before time t0 is a light emission period of the organic EL device 51 in a previous display frame (a previous frame). In the light emission period of the previous frame, the potential DS of the power supply line 32 is at the first power supply potential (hereinafter referred to as "high potential") Vcc, and the write transistor 53 is in a non-conduction state.

In this case, the drive transistor 52 is designed to operate in a saturation region. Therefore, a drive current (a drain-source current) Ids corresponding to a gate-source voltage Vgs of the drive transistor 52 is supplied from the power supply line 32 to the organic EL device 51 through the drive transistor 52. Then, the organic EL device 51 emits light with luminance corresponding to the current value of the drive current Ids.

At the time t0, a new display frame (the present frame) of line-sequential scanning starts. The potential DS of the power supply line 32 is switched from the high potential Vcc to the second power supply potential (hereinafter referred to as "low potential") Vini sufficiently lower than Vofs−Vth with respect to the reference voltage Vofs of the signal line 33, where a threshold voltage of the drive transistor 52 is Vth.

It is assumed that a threshold voltage of the organic EL device 51 is Vthe1, and a potential (cathode potential) of the common power supply line is Vcath. At this time, in a case where the low potential Vini is lower than Vthe1+Vcath, i.e., Vini<Vthe1+Vcath is established, a potential at the B-point is substantially equal to the low potential Vini; therefore, the organic EL device 51 is turned to a reverse bias state, and is turned off.

At time t1, the potential of the signal line 33 is switched from the signal voltage Vsig to the reference voltage Vofs, and at time t2, the write transistor 53 is turned to a conduction state by transitioning the potential WS of the scanning line 31 from a low-potential side to a high-potential side. At this time, the reference voltage Vofs is supplied from the horizontal selector 14 to the signal line 33; therefore, a potential at the A-point is switched to the reference voltage Vofs. Moreover, the potential at the B point is at a sufficiently lower potential than the reference voltage Vofs, i.e., at the low potential.

Moreover, at this time, the gate-source voltage Vgs of the drive transistor 52 is equal to Vofs−Vini. Unless Vofs−Vini is larger than the threshold voltage Vth of the drive transistor 52 at this time, threshold value correction that will be described later is not allowed to be performed; therefore, it is necessary to establish a relationship of Vofs−Vini>Vth.

Thus, a process of initializing by fixing the potential at the A-point to the reference voltage Vofs, and fixing the potential at the B-point to the low potential Vini is a preparation (threshold value correction preparation) process before performing the threshold value correction that will be described later.

At time t3, when the potential DS of the power supply line 32 is switched from the low voltage Vini to the high potential Vcc, the threshold value correction starts under a state in which the potential at the A-point is maintained at the reference voltage Vofs. In other words, the potential at the B-point starts increasing toward a potential obtained by subtracting the threshold voltage Vth of the drive transistor 52 from the potential at the A-point.

When this threshold value correction progresses, the gate-source voltage Vgs of the drive transistor 52 is converged to the threshold voltage Vth of the drive transistor 52. A voltage corresponding to the threshold voltage Vth is held by the retention capacitor 54.

It is to be noted that, in a period (threshold value correction period) in which the threshold value correction is performed, to allow a current to exclusively flow to the retention capacitor 54 and not to flow to the organic EL device 51, the potential Vcath of the common power supply line is so set as to turn the organic EL device 51 to a cut-off state.

At time t4, the write transistor 53 is turned to the non-conduction state by transitioning the potential WS of the scanning line 31 to the low-potential side. At this time, the gate electrode of the drive transistor 52 is turned to a floating state by electrically separating the gate electrode of the drive transistor 52 from the signal line 33. However, since the gate-source voltage Vgs is equal to the threshold voltage Vth of the drive transistor 52, the drive transistor 52 is in the cut-off state. Therefore, the drive current Ids does not flow through the drive transistor 52.

At time t5, the potential of the signal line 33 is switched from the reference voltage Vofs to the signal voltage Vsig of the image signal. Next, at time t6, the write transistor 53 is turned to the conduction state by transitioning the potential WS of the scanning line 31 to the high-potential side, and the write transistor 53 samples the signal voltage Vsig of the image signal to write the signal voltage Vsig of the image signal to the pixel 30.

The potential at the A-point is switched to the signal voltage Vsig by this writing of the signal voltage Vsig by the write transistor 53. Then, at the time of driving of the drive transistor 52 by the signal voltage Vsig of the image signal, the threshold voltage Vth of the drive transistor 52 and the threshold voltage Vth held by the retention capacitor 54 cancel each other out.

At this time, the organic EL device 51 is in the cut-off state (a high-impedance state). Therefore, the drive current Ids flowing from the power supply line 32 to the drive transistor 52, based on the signal voltage Vsig of the image signal flows to equivalent capacity of the organic EL device 51 and the auxiliary capacitor 55. Thus, charging of the equivalent capacity of the organic EL device 51 and the auxiliary capacitor 55 starts.

Since the equivalent capacity of the organic EL device 51 and the auxiliary capacitor 55 are charged, the potential at the B-point increases over time. At this time, variation from pixel to pixel in the threshold voltage Vth of the drive transistor 52 has been already cancelled, and the drive current Ids of the drive transistor 52 is dependent on mobility μ of the drive transistor 52. It is to be noted that the mobility μ of the drive transistor 52 is mobility of a semiconductor thin film configuring a channel of the drive transistor 52.

It is assumed that a ratio of a retention voltage (a gate-source voltage of the drive transistor 52) Vgs of the retention capacitor 54 to the signal voltage Vsig of the image signal, i.e., a write gain is 1 (an ideal value). Thus, when the potential at the B-point increases to a potential of Vofs−Vth+ΔV, the gate-source voltage Vgs of the drive transistor 52 reaches Vsig−Vofs+Vth−ΔV.

More specifically, an increased amount ΔV of the potential at the B-point functions so as to be subtracted from the voltage (Vsig−Vofs+Vth) held by the retention capacitor 54, i.e., so as to discharge a charged charge of the retention capacitor 54. In other words, the increased amount ΔV of the potential at the B-point is negatively fed back to the retention capacitor 54. Therefore, the increased amount ΔV of the potential at the B-point is a negative feedback amount.

Thus, when the feedback amount ΔV corresponding to the drive current Ids flowing through the drive transistor 52 is negatively fed back to the gate-source voltage Vgs, dependence of the drive current Ids of the drive transistor 52 on the mobility μ is allowed to be cancelled. This process is mobility correction in which variation from pixel to pixel in mobility μ of the drive transistor 52 is corrected.

(Principle of Mobility Correction)

Figure 4:
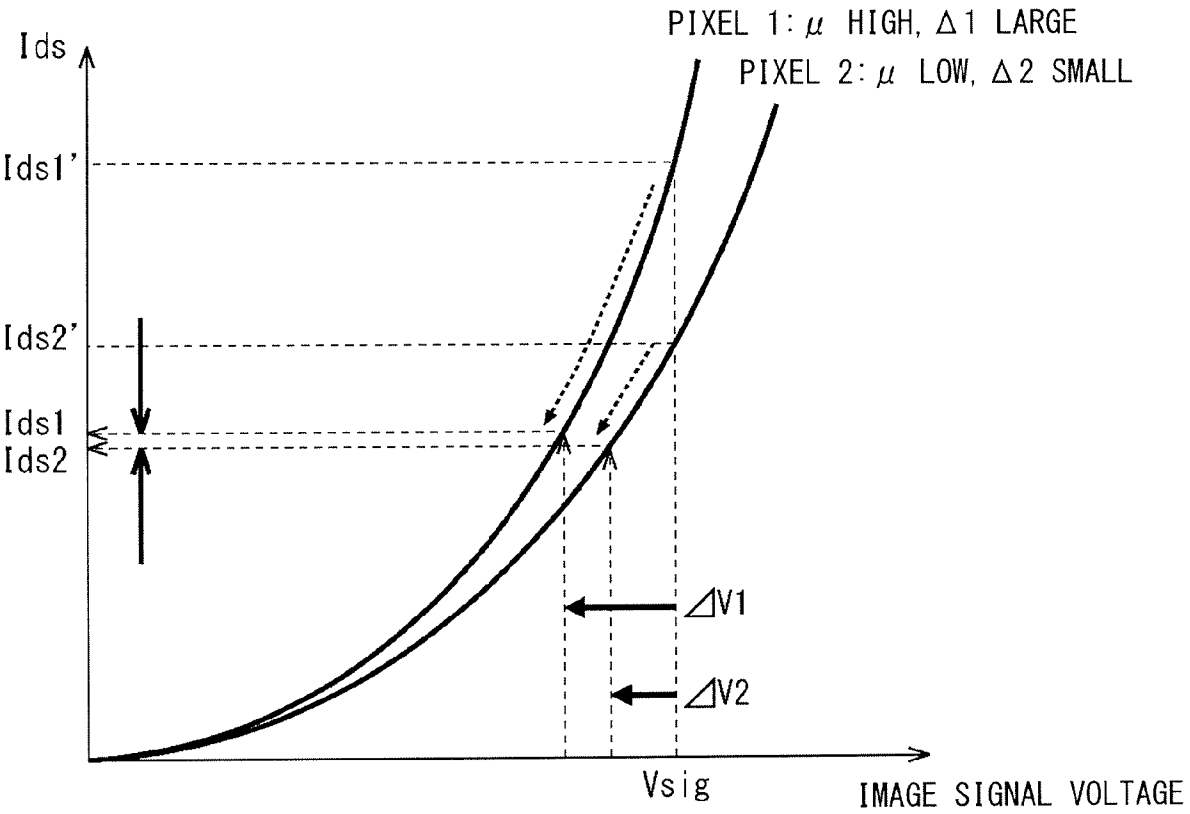
FIG. 4 is a diagram for describing variation in mobility of a drive transistor.

Referring to FIG. 4, a principle of mobility correction on the drive transistor 52 will be described below.

FIG. 4 illustrates characteristic curves in a state in which a pixel A including the drive transistor 52 with relatively large mobility μ and a pixel B including the drive transistor 52 with relatively small mobility μ are compared with each other. In a case where each of the drive transistors 52 is configured of a polysilicon thin film transistor or the like, as with the pixel A and the pixel B, variation in mobility μ between pixels is inevitable.

For example, a case is considered where a same signal amplitude Vin (=Vsig−Vofs) is written to both of the pixels A and B under a state in which variation in mobility μ between the pixel A and the pixel B occurs. In this case, unless some correction to the mobility μ is performed, a large difference is caused between a drive current Ids1' flowing through the pixel A with large mobility μ and a drive current Ids2' flowing through the pixel B with small mobility μ. When a large difference in the drive current Ids between the pixels is caused by variation in mobility μ between the pixels, uniformity of a screen is impaired.

It is known that, in a case where the mobility μ is large, the drive current Ids is large. Therefore, the more the mobility μ is increased, the more the feedback amount ΔV in negative feedback is increased. As illustrated in FIG. 4, a feedback amount ΔV1 of the pixel A with large mobility μ is larger than a feedback amount ΔV2 of the pixel B with small mobility μ.

Therefore, since the feedback amount ΔV corresponding to the drive current Ids of the drive transistor 52 is negatively fed back to the gate-source voltage Vgs by the mobility correction, the larger the mobility μ is, the larger negative feedback is applied. As a result, variation in mobility μ from pixel to pixel is allowed to be reduced.

More specifically, when correction to the feedback amount ΔV1 in the pixel A with large mobility μ is performed, the drive current Ids is largely decreased from Ids1' to Ids1. On the other hand, since the feedback amount ΔV2 of the pixel B with small mobility μ is small, the drive current Ids is decreased from Ids2' to Ids2, i.e., is not so much decreased. As a result, the drive current Ids1 of the pixel A and the drive current Ids2 of the pixel B become substantially equal to each other; therefore, variation in mobility μ between the pixels is corrected.

Referring back to the timing chart in FIG. 3, at time t7, the write transistor 53 is turned to the non-conduction state by transitioning the potential WS of the scanning line 31 to the low-potential side. Therefore, the gate electrode of the drive transistor 52 is electrically separated from the signal line 33 to be turned to the floating state.

Since the retention capacitor 54 is connected between the gate and the source of the drive transistor 52, in a case where the gate electrode of the drive transistor 52 is in a floating state, the potential at the A-point (the gate potential of the drive transistor 52) is varied with variation in the potential (the source potential of the drive transistor 52) at the B-point.

An operation in which the gate potential of the drive transistor 52 is varied with variation in the source potential of the drive transistor 52 in such a manner, i.e., an operation in which the gate potential and the source potential of the drive transistor 52 are increased while maintaining the gate-source voltage Vgs held by the retention capacitor 54 is a so-called bootstrap operation.

When the gate electrode of the drive transistor 52 is turned to the floating state, and at the same time, the drive current Ids of the drive transistor 52 starts flowing through the organic El device 51, the anode potential of the organic EL device 51 is increased.

Then, when the anode potential of the organic EL device 51 exceeds Vthe1+Vcath, a drive current starts flowing through the organic EL device 51, and the organic EL device 51 starts emitting light accordingly. Moreover, an increase in the anode potential of the organic EL device 51 means an increase in the source potential of the drive transistor 52, i.e., an increase in the potential at the B-point. Then, when the potential at the B-point is increased, the potential at the A-point is increased in conjunction with the increase in the potential at the B-point by the bootstrap operation of the retention capacitor 54.

At this time, assuming that a bootstrap gain is 1 (an ideal value), an increased amount of the potential at the A-point is equal to an increased amount of the potential at the B-point. Therefore, the gate-source voltage Vgs of the drive transistor 52 is maintained at a fixed value of Vsig−Vofs+Vth−ΔV during a light emission period. Then, at time t8, the potential of the signal line 33 is switched from the signal voltage Vsig of the image signal to the reference voltage Vofs.

In the above-described circuit operation, threshold value correction preparation, threshold value correction, writing of the signal voltage Vsig (signal writing), and mobility correction are executed in one horizontal scanning period (1H). Moreover, the signal writing and the mobility correction are concurrently executed in a period from the time t6 to the time t7.

(Divided Threshold Correction)

It is to be noted that, a circuit operation in which threshold value correction is executed only once is described above; however, this circuit operation is merely an example, and the circuit operation according to the embodiment of the present technology is not limited thereto. For example, a circuit operation in which, in addition to the 1H period in which the threshold value correction is performed together with the mobility correction and the signal writing, the threshold value correction is dividedly executed a plurality of times over a plurality of horizontal scanning periods preceding the 1H period, i.e., so-called divided threshold value correction is performed may be adopted.

In the circuit operation of this divided threshold value correction, even if a period assigned as one horizontal scanning period is shortened due to an increase in number of pixels associated with higher definition, sufficient time is allowed to be secured throughout the plurality of horizontal scanning periods as a threshold value correction period. Therefore, even if the time assigned as one horizontal scanning period is shortened, sufficient time is allowed to be secured as the threshold value correction period; therefore, the threshold value correction is allowed to be reliably executed.

(Control of the Potential of Intermediate Node)

In the pixel 30, the potential of the intermediate node N of the write transistor 53 is controlled by a scanning signal WSmid. More specifically, when the switching transistor 56 is turned on in response to the scanning signal WSmid, the potential of the intermediate node N of the write transistor 53 is turned to a predetermined potential Vmid. The predetermined potential Vmid is a potential between the potential of the signal line 33 and the potential of the gate electrode of the drive transistor 52, for example, a substantially intermediate potential between the potential of the signal line 33 and the potential of the gate electrode of the drive transistor 52. The predetermined potential Vmid is hereinafter referred to as "intermediate potential Vmid".

Referring to a timing chart in FIG. 5, an operation example of controlling the potential of the intermediate node N of the write transistor 54 by the scanning signal Wsmid will be described below.

Figure 5:
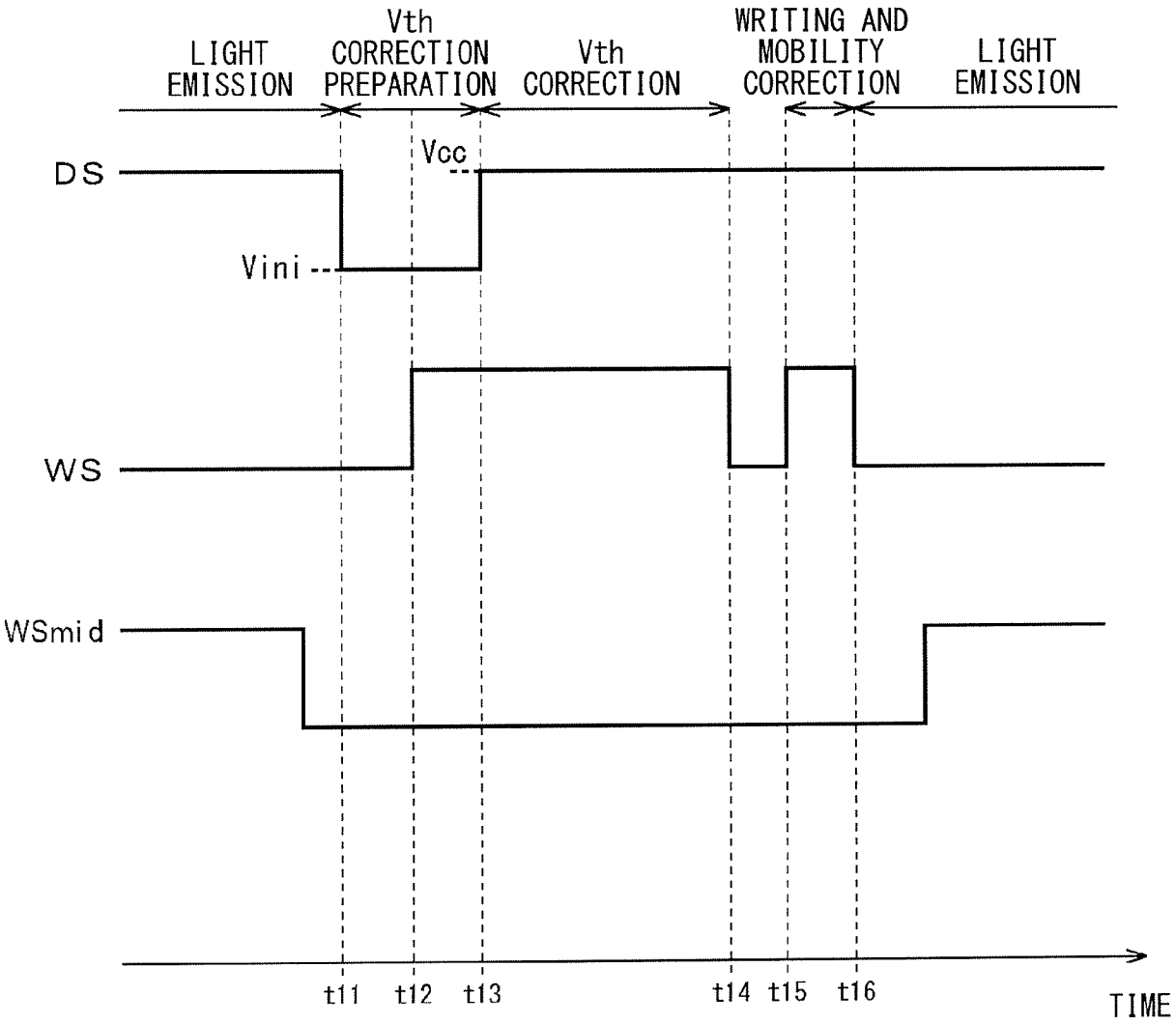
FIG. 5 is a timing chart for describing control of a potential of an intermediate node.

The timing chart in FIG. 5 illustrates variations in the potential DS of the power supply line 32, the potential WS of the scanning line 31, and the scanning signal Wsmid of the scanning line 34.

It is to be noted that, in the timing chart in FIG. 5, variations in the potential DS of the power supply line 32 and the potential WS of the scanning line 31 are the same as those in the timing chart in FIG. 3. Moreover, although not illustrated, variation in the potential (Vsig/Vofs) of the signal line 33 is also the same as that in the timing chart in FIG. 3. In other words, as illustrated in the timing chart in FIG. 5, the threshold value correction preparation is performed in a period from time t11 to time t13, the threshold value correction is performed in a period from time t13 to time t14, and each of signal writing and mobility correction is performed in a period from time t15 to time t16. A period from the time t15 onward is a light emission period.

As illustrated in FIG. 5, in a light emission period in a previous frame, the switching transistor 56 is turned to the non-conduction state by transitioning the scanning signal WSmid of the scanning line 34 from the high potential to the low potential. This state continues while the threshold value correction preparation, the threshold value correction, the signal writing, and the mobility correction are performed.

Then, in a light emission period from the time t16 onward, the switching transistor 56 is turned to the conduction state by transitioning the scanning signal WSmid of the scanning line 34 from the low potential to the high potential. In other words, the gate driver 15 turns the switching transistor 56 on during light emission from the organic EL device 51. Thus, the potential of the intermediate node N of the write transistor 53 is turned to the intermediate potential Vmid.

As described above referring to the timing chart in FIG. 3, in the light emission period, while the gate potential (the potential at the A-point in FIG. 2) of the drive transistor 52 is turned to the high potential, the potential of the signal line 33 is decreased from the signal voltage Vsig to the reference voltage Vofs. The potential of the intermediate node N of the write transistor 53 at this time is turned to WS_L−Vth, where a potential (a potential at a low-potential side) of the scanning line 31 when the write transistor 53 is turned off is WS_L, and a threshold voltage of the transistor device 53-1 is Vth. This potential is sufficiently lower than the gate potential of the drive transistor 52 in the light emission period; therefore, a large reverse bias is applied to the write transistor 53, specifically the transistor device 53-2 located closer to the drive transistor 52.

Therefore, in this embodiment of the present technology, in the light emission period of the organic EL device 51, the potential of the intermediate node N of the write transistor 53 is turned to the intermediate potential Vmid by turning the switching transistor 56 on. In this case, the intermediate potential Vmid is at least lower than the gate potential of the drive transistor 52 during light emission (for example, white light emission) from the organic EL device 51 and higher than the above-described WS_L−Vth. Thus, the reverse bias applied to the transistor device 53-2 is allowed to be reduced.

Figure 6:
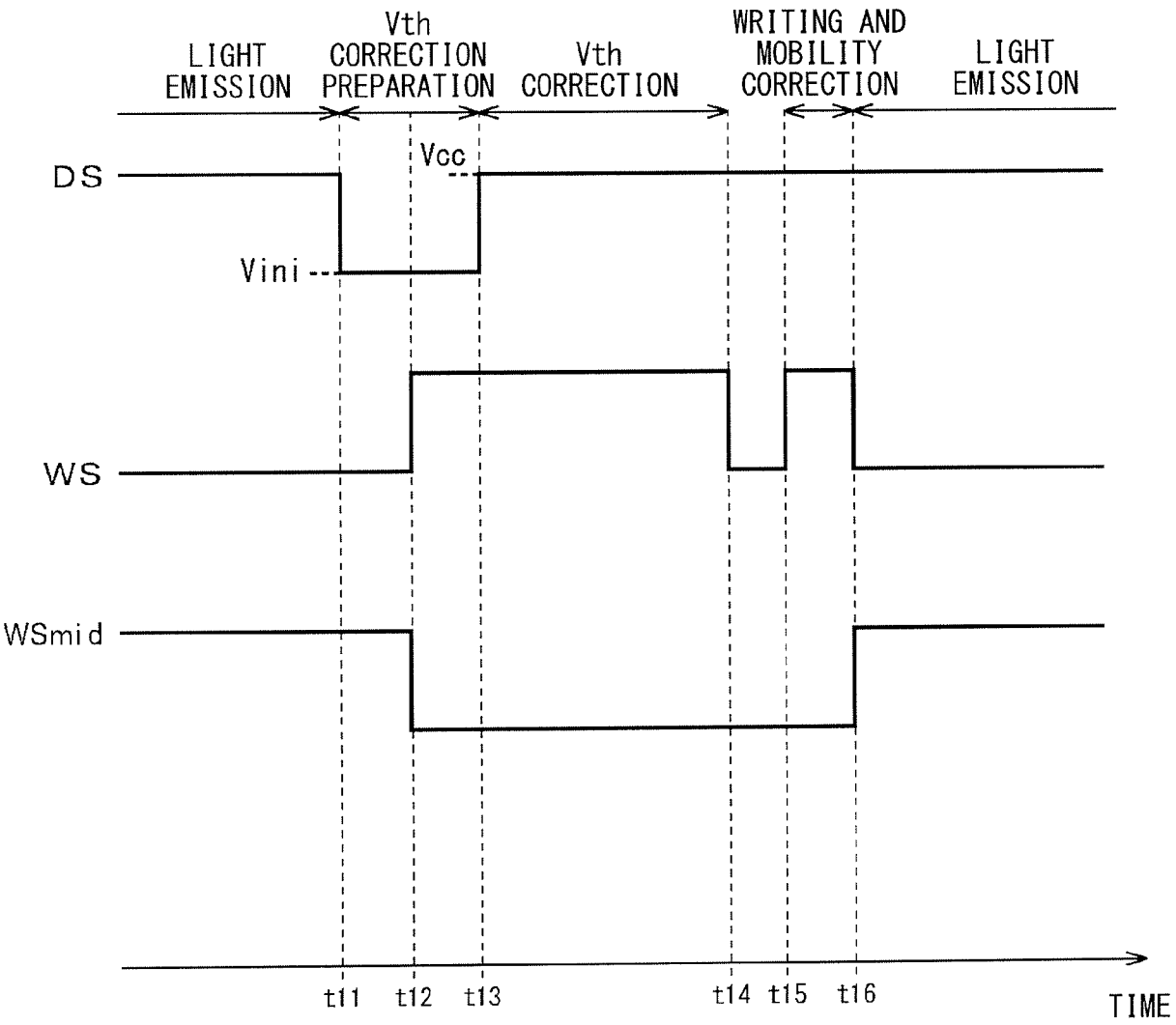
FIG. 6 is a timing chart for describing control of the potential of the intermediate node.

It is to be noted that, in the timing chart in FIG. 5, after the organic EL device 51 starts emitting light, the switching transistor 56 is turned on, and before the organic EL device 51 stops emitting light, the switching transistor 56 is turned off; however, the switching transistor 56 may be turned on at least after the completion of the signal writing by the write transistor 53, and the switching transistor 56 may be turned off by the time the write transistor 53 is turned on in a threshold value correction preparation period. Therefore, as illustrated in FIG. 6, the switching transistor 56 may be turned on at the time (the time t16) of the completion of the signal writing by the write transistor 53, and the switching transistor 56 may be turned off at the time (the time t12) when the write transistor 53 is turned on in the threshold value correction preparation period.

In the above operation, the switching transistor 56 is turned on after the completion of the signal writing by the write transistor 53; therefore, the potential of the intermediate node N of the write transistor 53 during the light emission is allowed to be turned to the intermediate potential Vmid. Thus, during the light emission, in the write transistor 53, the reverse bias applied to the transistor device 53-2 located closer to the drive transistor 52 is allowed to be reduced; therefore, a shift of the threshold voltage of the transistor device 53-2 toward a depression side is allowed to be suppressed, and as a result, reliability of a screen is allowed to be ensured.

In a case where the write transistor 53 is considered as one transistor, an example in which the present technology is applied to an organic EL display unit including a pixel circuit with a so-called 2tr/2c configuration with two transistors, i.e., the drive transistor 52 and the write transistor 54 and two capacitors, i.e., the retention capacitor 54 and the auxiliary capacitor 55 is described above; however, the present technology is applicable to an organic EL display unit including a pixel circuit with any other configuration. In other words, the embodiment of the present technology is applicable to an organic EL display unit including a pixel circuit that includes a larger number of transistors or a pixel circuit that includes a larger number of capacitors.

(Other Configuration Example of Display Unit)

Figure 7:
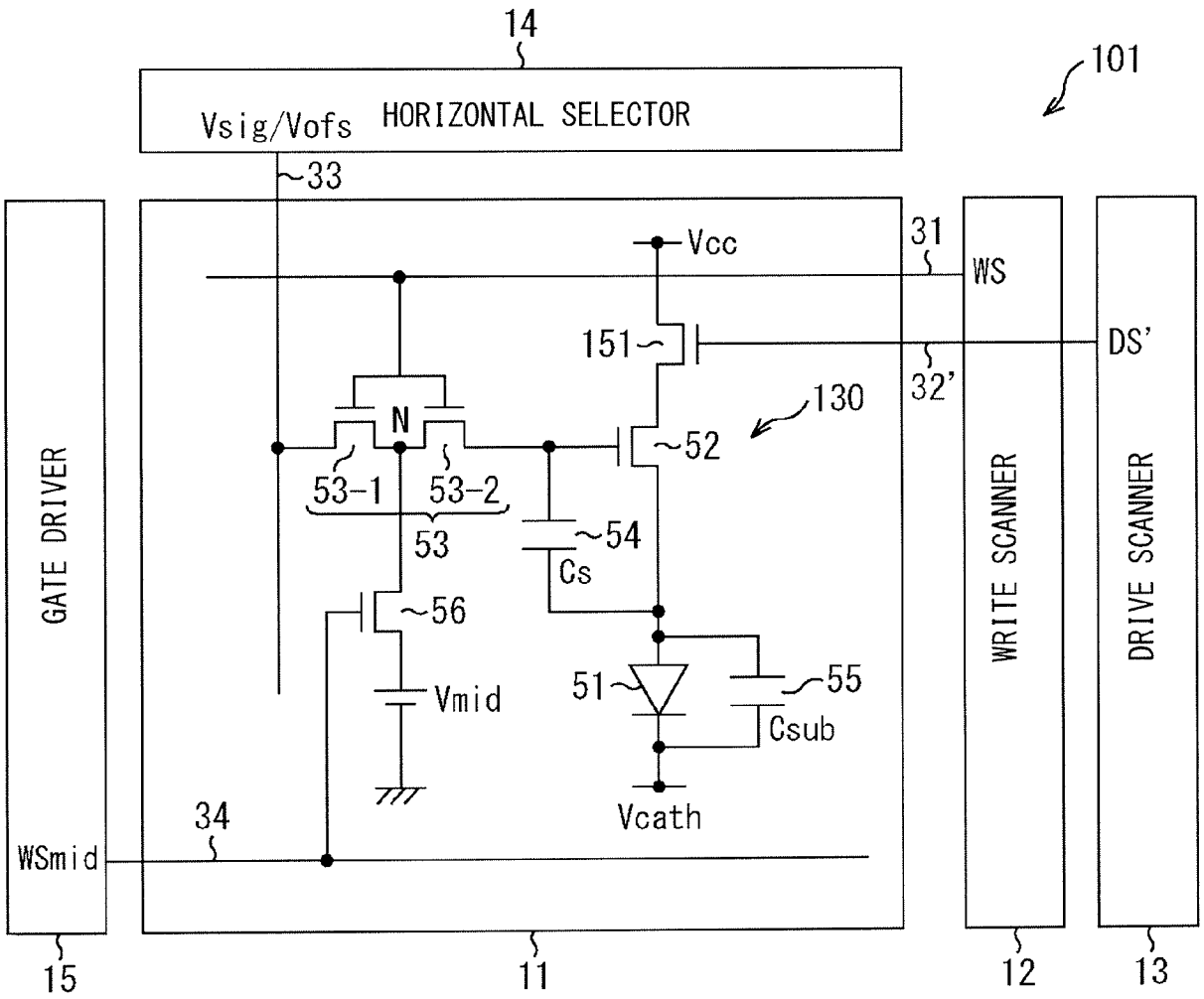
FIG. 7 is a diagram illustrating another configuration example of the pixel circuit.

FIG. 7 illustrates a configuration example of an active matrix organic EL display unit including a pixel circuit with a 3Tr/2C configuration.

Figure 8:
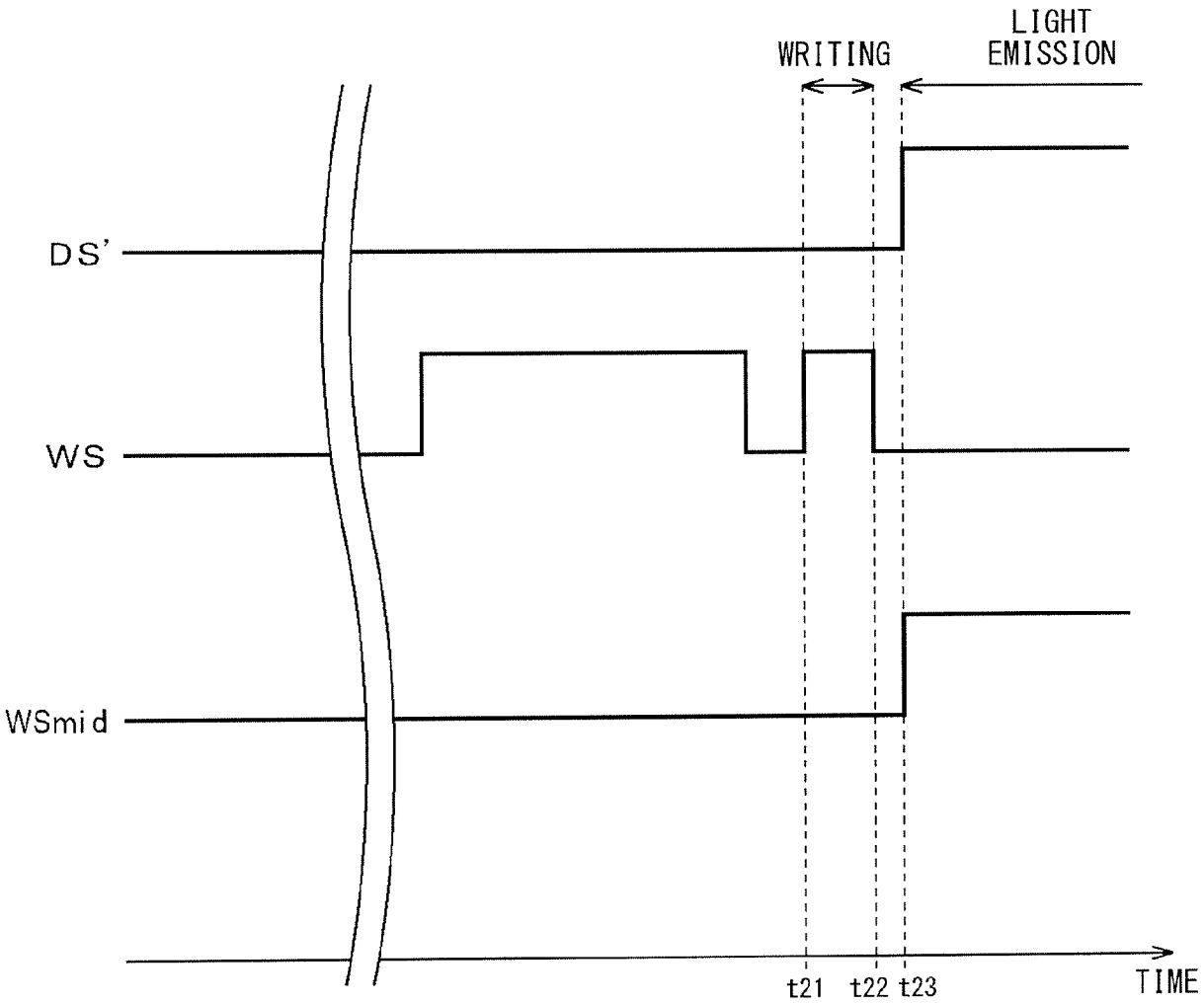
FIG. 8 is a timing chart for describing control of the potential of the intermediate node.

It is to be noted that, in an organic EL display unit 101 in FIG. 8, components similar in function to those in the organic EL display unit 1 in FIG. 2 are designated by similar names and similar reference numerals, and will not be further described.

The organic EL display unit 101 in FIG. 7 differs from the organic EL display unit 1 in FIG. 2 in that pixels 130 are included instead of the pixels 30. Moreover, each of the pixels 130 in FIG. 7 differs from each of the pixels 30 in FIG. 2 in that a switching transistor 151 is further included.

In the switching transistor 151, one electrode (of a source electrode and a drain electrode) is connected to the fixed potential Vcc, and the other electrode (of the source electrode and the drain electrode) is connected to the source electrode or the drain electrode of the drive transistor 52. Moreover, a gate electrode of the switching transistor 151 is connected to a scanning line 32'.

It is to be noted that, in the organic EL display unit 101 in FIG. 7, the drive scanner 13 supplies a scanning signal DS' to the scanning line 32' in synchronization with line-sequential scanning by the write scanner 12 to perform control of emission and non-emission of light from the pixel 130. More specifically, the switching transistor 151 controls supply of the drive current Ids of the organic EL device 51 by the drive transistor 52 in response to the scanning signal DS' from the scanning line 32'.

(Operation of Pixel Circuit)

Next, referring to a timing chart in FIG. 8, an operation of the pixel circuit 130 of the organic EL display unit 101 will be described below.

The timing chart in FIG. 8 illustrates variations in the potential DS' of the scanning line 32', the potential WS of the scanning line 31, and the scanning signal WSmid of the scanning line 34.

In the timing chart in FIG. 8, a process performed before time t21, more specifically, each of the threshold value correction preparation and the threshold value correction will not be further described; however, as illustrated in the timing chart in FIG. 8, the signal writing is performed in a period from time t21 to time t22, and a period from time t23 onward is a light emission period. It is to be noted that, in the timing chart in FIG. 8, the mobility correction is not performed.

As illustrated in FIG. 8, after the completion of the signal writing, at the start of light emission at the time t12, the switching transistor 56 is turned to the conduction state by transitioning the scanning signal Wsmid of the scanning line 34 from the low potential to the high potential. In other words, the gate driver 15 turns the switching transistor 56 on simultaneously with when turning the switching transistor 151 on. Thus, the potential of the intermediate node N of the write transistor 53 is turned to the intermediate potential Vmid.

In the above operation, after the signal writing by the write transistor 53, the switching transistor 56 is turned on simultaneously with when turning the switching transistor 151 on; therefore, the potential of the intermediate node N of the write transistor 53 during the light emission is allowed to be turned to the intermediate potential Vmid. Thus, during the light emission, in the write transistor 53, the reverse bias applied to the transistor device 53-2 located closer to the drive transistor 52 is allowed to be reduced; therefore, a shift of the threshold voltage of the transistor device 53-2 toward the depression side is allowed to be suppressed, and as a result, reliability of the screen is allowed to be ensured.

It is to be noted that, as described above, the switching transistor 56 and the switching transistor 151 are turned on at the same time; therefore, in the organic EL display unit 101, one circuit that serves as both the drive scanner 13 and the gate driver 15 may be included. Thus, the configuration of the organic EL display unit 101 is allowed to be simplified.

Moreover, as described above, the write transistor 53 has a double-gate configuration; however, the write transistor 53 may have a multi-gate configuration in which three or more transistor devices are connected to one another in series. In this case, the intermediate node is located at a connection point between a transistor device located closest to the drive transistor 52 and another transistor device selected from the three or more transistor devices. Thus, during the light emission, the reverse bias applied to the transistor device located closest to the drive transistor 52 is allowed to be reduced.

Although the configurations and operations of the organic EL display units according to the embodiments of the present technology are described above, the present technology is applicable to any other display units. More specifically, the present technology is applicable to any display units using a current-driven electro-optical device (a light-emitting device), such as an inorganic EL device, an LED device, or a semiconductor laser diode, in which light emission luminance is varied with a current value of a current flowing through the device. Moreover, the present technology is applicable to any display units with a configuration including a capacitor in a pixel such as liquid crystal display units and plasma display units in addition to the display units using the current-driven electro-optical device.

(Electronic Apparatus)

The display units according to the above-described embodiments of the present technology are applicable to display sections (display units) of electronic apparatuses, in any fields, displaying, as an image, an image signal input to the electronic apparatuses or an image signal generated in the electronic apparatuses. For example, the display units according to the embodiments of the present technology may be applicable to display sections of various electronic apparatuses illustrated in FIGS. 9 to 13.

As described above, in the display units according to the embodiments of the present technology, reliability of the screen is allowed to be ensured. Therefore, when the display units according to the embodiments of the present technology are used as display sections of electronic apparatuses in any fields, a high-quality display image is allowed to be obtained.

The display units according to the embodiments of the present technology include display units in a module form with a sealed configuration. For example, the display units according to the embodiments of the present technology include a display module formed by bonding a counter section such as transparent glass to a pixel array section. It is to be noted that a circuit section, an FPC (flexible printed circuit), or the like configured to input and output a signal or the like from an external component to the pixel array section may be provided to the display module.

Specific examples of the electronic apparatuses to which any one of the display units according to the embodiments of the present technology is applied will be described below.

Figure 9:
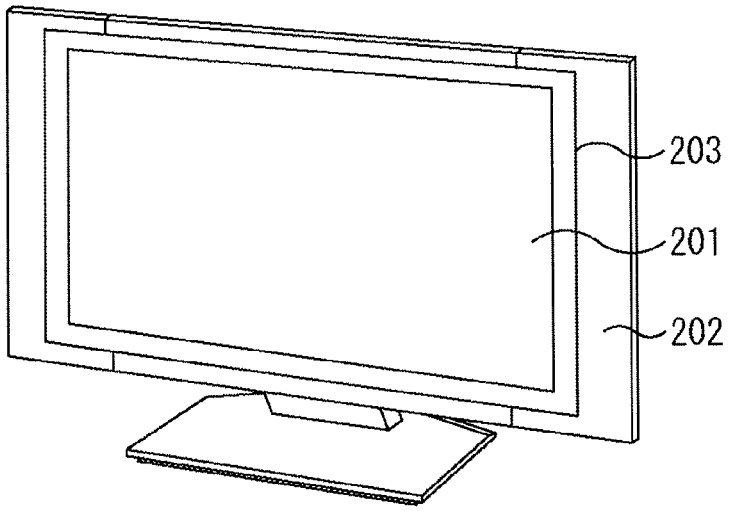
FIG. 9 is a diagram illustrating an appearance of a television to which the embodiment of the present technology is applied.

FIG. 9 is a perspective view illustrating an appearance of a television to which any one of the display units according to the embodiments of the present technology is applied. The television includes an image display screen section 201 configured of a front panel 202, a filter glass 203, and the like, and is formed using, as the image display screen section 201, any one of the display units according to the embodiments of the present technology.

Figure 10A:
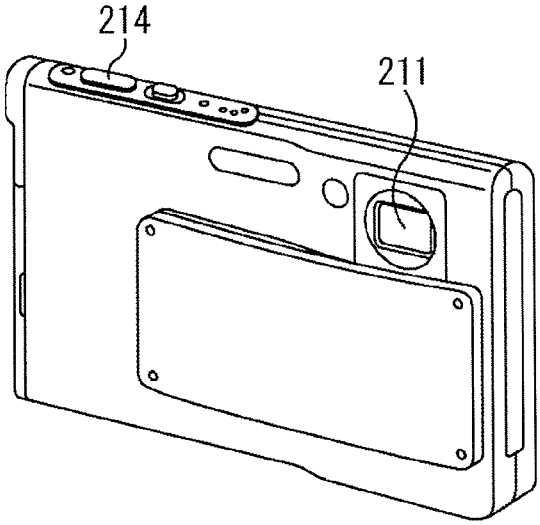
FIGS. 10A and 10B are diagrams illustrating an appearance of a digital camera to which the embodiment of the present technology is applied.
Figure 10B:
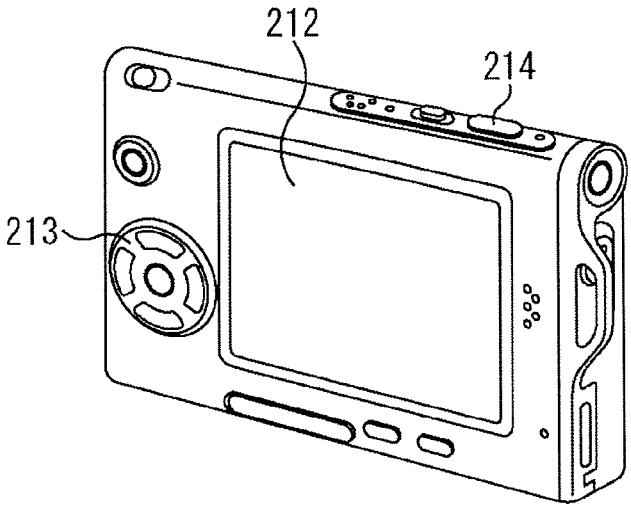

FIGS. 10A and 10B are perspective views illustrating an appearance of a digital camera to which any one of the display units according to the embodiments of the present technology is applied. FIG. 10A is a perspective view from a front side, and FIG. 10B is a perspective view from a back side. The digital camera includes a light-emitting section 211 for a flash, a display section 212, a menu switch 213, a shutter button 214, and the like, and is formed using, as the display section 212, any one of the display units according to the embodiments of the present technology.

Figure 11:
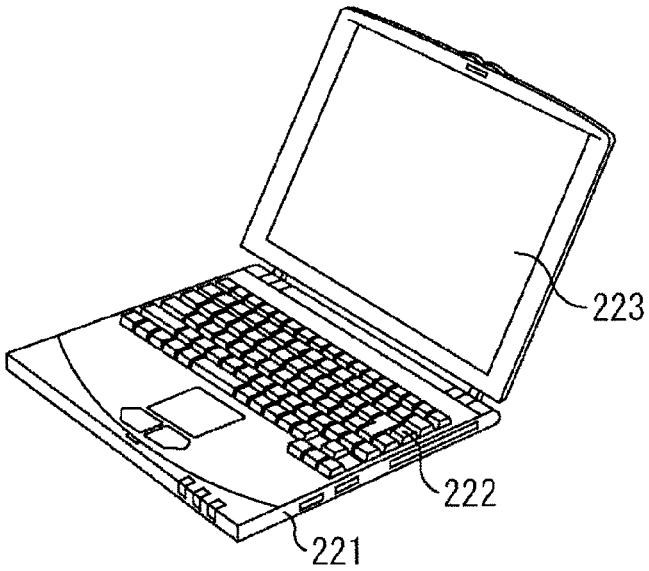
FIG. 11 is a diagram illustrating an appearance of a notebook personal computer to which the embodiment of the present technology is applied.

FIG. 11 is a perspective view illustrating an appearance of a notebook personal computer to which any one of the display units according to the embodiments of the present technology is applied. The notebook personal computer includes a keyboard 222 for operation of inputting characters and the like, a display section 223 for displaying an image, and the like in a main body 221, and is formed using, as the display section 223, any one of the display units according to the embodiments of the present technology.

Figure 12:
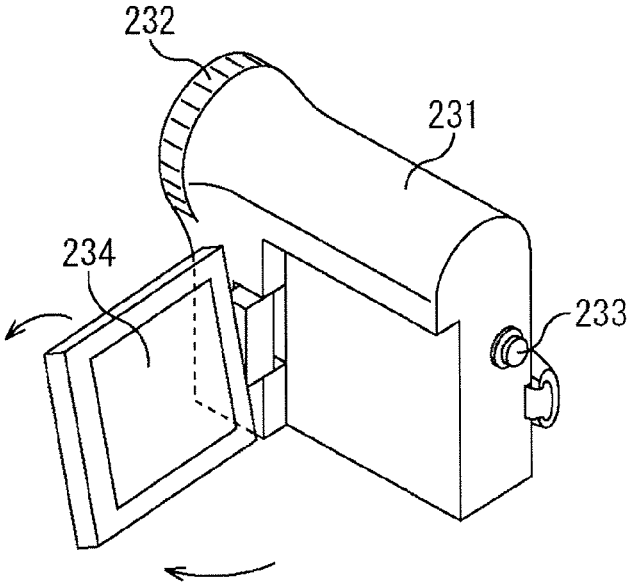
FIG. 12 is a diagram illustrating an appearance of a digital video camera to which the embodiment of the present technology is applied.

FIG. 12 is a perspective view illustrating an appearance of a video camera to which any one of the display units according to the embodiments of the present technology is applied. The video camera includes a main body 231, a lens 232 for shooting an image of an object, a shooting start and stop switch 233, a display section 234, and the like, and is formed using, as the display section 234, any one of the display units according to the embodiments of the present technology.

Figure 13:
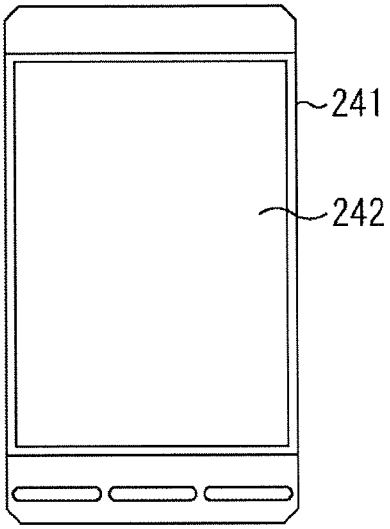
FIG. 13 is a diagram illustrating an appearance of a multifunctional cellular phone to which the embodiment of the present technology is applied.

FIG. 13 is an external view illustrating a portable terminal, for example, a multifunctional cellular phone to which any one of the display units according to the embodiments of the present technology is applied. The multifunctional cellular phone includes an enclosure 241, a display 242 with a touch panel function, a camera (not illustrated), and the like, and is formed using, as the display 242, any one of the display units according to the embodiments of the present technology.

It is to be noted that the present technology is not limited to the above-described embodiments, and may be embodied by variously modifying the embodiments without departing from the scope of the present technology.

Moreover, the present technology may have the following configurations.

(1) A display unit including:

a pixel array section configured of pixels arranged in a matrix form, each of the pixels including an electro-optical device, a drive transistor, and a write transistor, the drive transistor configured to drive the electro-optical device, and the write transistor connected between a signal line and a gate electrode of the drive transistor and configured of a plurality of transistor devices connected to one another in series; and a drive circuit section configured to drive each of the pixels of the pixel array section, in which a potential of an intermediate node between two transistor devices selected from the plurality of transistor devices configuring the write transistor is turned to an intermediate potential between a potential of the signal line and a potential of the gate electrode of the drive transistor after completion of signal writing by the write transistor.

(2) The display unit according to (1), in which each of the pixels includes a switch configured to write the intermediate potential to the intermediate node of the write transistor, and the drive circuit section turns the switch on after the completion of the signal writing by the write transistor.

(3) The display unit according to (2), in which each of the pixels further includes a switching transistor configured to control supply of a drive current of the electro-optical device by the drive transistor, and the drive circuit section turns the switch on simultaneously with when turning the switching transistor on.

(4) The display unit according to any one of (1) to (3), in which the intermediate potential is lower than a potential of the gate electrode of the drive transistor during light emission from the electro-optical device.

(5) The display unit according to any one of (1) to (4), in which the intermediate potential is higher than a potential obtained by subtracting a threshold voltage of a transistor device located closer to the signal line than the intermediate node selected from the plurality of transistor devices configuring the write transistor from a potential of a scanning line of the write transistor when the write transistor is off.

(6) The display unit according to any one of (1) to (5), in which the intermediate node is located at a connection point between a transistor device located closest to the drive transistor and another transistor device selected from the plurality of transistor devices configuring the write transistor.

(7) A method of driving a display unit, the method including:

preparing, in the display unit, a pixel array section and a drive circuit section, the pixel array section configured of pixels arranged in a matrix form, each of the pixels including an electro-optical device, a drive transistor, and a write transistor, the drive transistor configured to drive the electro-optical device, the write transistor connected between a signal line and a gate electrode of the drive transistor and configured of a plurality of transistor devices connected to one another in series, and the drive circuit section configured to drive each of the pixels of the pixel array section; and turning a potential of an intermediate node between two transistor devices selected from the plurality of transistor devices configuring the write transistor to an intermediate potential between a potential of the signal line and a potential of the gate electrode of the drive transistor after completion of signal writing by the write transistor.

(8) An electronic apparatus provided with a display unit, the display unit including:

a pixel array section configured of pixels arranged in a matrix form, each of the pixels including an electro-optical device, a drive transistor, and a write transistor, the drive transistor configured to drive the electro-optical device, and the write transistor connected between a signal line and a gate electrode of the drive transistor and configured of a plurality of transistor devices connected to one another in series; and a drive circuit section configured to drive each of the pixels of the pixel array section, in which a potential of an intermediate node between two transistor devices selected from the plurality of transistor devices configuring the write transistor is turned to an intermediate potential between a potential of the signal line and a potential of the gate electrode of the drive transistor after completion of signal writing by the write transistor.

It should be understood by those skilled in the art that various modifications, combinations, sub-combinations, and alterations may occur depending on design requirements and other factors insofar as they are within the scope of the appended claims or the equivalents thereof.

What is claimed is:

1. A display unit comprising:

a pixel array section with pixels arranged in a matrix, each of the pixels including a light-emitting electro-optical device, a drive transistor, a switch, and a write transistor, the drive transistor connected to and configured to drive the electro-optical device, the write transistor connected between a signal line and a gate electrode of the drive transistor and configured of a plurality of transistor devices connected to one another in series with gates of all of the plurality of transistor devices commonly connected to a same scan line, the switch connected between an intermediate node between two transistor devices selected from the plurality of transistor devices configuring the write transistor and a potential; and a drive circuit section configured to drive each of the pixels of the pixel array section, wherein, a potential of the intermediate node between the two transistor devices selected from the plurality of transistor devices configuring the write transistor is placed at the potential which is an intermediate potential between a potential of the signal line and a potential of the gate electrode of the drive transistor by operation of the switch after completion of signal writing by the write transistor during light emission by the light-emitting electro-optical device.

2. The display unit according to claim 1, wherein the drive circuit section turns the switch on after the completion of the signal writing by the write transistor.

3. The display unit according to claim 2, wherein:

each of the pixels further includes a switching transistor between the drive transistor and a power supply and configured to control supply of a drive current of the electro-optical device by the drive transistor in accordance with a power supply signal, and the drive circuit section turns the switch on simultaneously with when turning the switching transistor on.

4. The display unit according to claim 1, wherein the intermediate potential is lower than a potential of the gate electrode of the drive transistor during light emission from the electro-optical device.

5. The display unit according to claim 1, wherein the intermediate potential is higher than a potential obtained by subtracting a threshold voltage of a transistor device that is one of the plurality of transistor devices and that is located closer to the signal line than the intermediate node from a potential of a scanning line of the write transistor when the write transistor is off.

6. The display unit according to claim 1, wherein the intermediate node is located at a connection point between a transistor device located closest to the drive transistor and another transistor device selected from the plurality of transistor devices configuring the write transistor.

7. A method of driving a display unit, the method comprising:

providing a display unit having a pixel array section and a drive circuit section, the pixel array section having pixels arranged in a matrix, each of the pixels including a light-emitting electro-optical device, a drive transistor, a write transistor, and a switch, the drive transistor connected to and configured to drive the electro-optical device, the write transistor connected between a signal line and a gate electrode of the drive transistor and configured of a plurality of transistor devices connected to one another in series with gates of all of the plurality of transistor devices commonly connected to a same scan line, the switch connected between an intermediate node between two transistor devices selected from the plurality of transistor devices configuring the write transistor and a potential, and the drive circuit section configured to drive each of the pixels of the pixel array section; and placing a potential of the intermediate node between the two transistor devices selected from the plurality of transistor devices configuring the write transistor to the potential which is an intermediate potential between a potential of the signal line and a potential of the gate electrode of the drive transistor by operation of the switch after completion of signal writing by the write transistor during light emission by the light-emitting electro-optical device.

8. An electronic apparatus provided with a display unit, the display unit comprising:

a pixel array section with pixels arranged in a matrix, each of the pixels including light-emitting electro-optical device, a drive transistor, a switch, and a write transistor, the drive transistor connected to and configured to drive the electro-optical device, the write transistor connected between a signal line and a gate electrode of the drive transistor and configured of a plurality of transistor devices connected to one another in series with gates of all of the plurality of transistor devices commonly connected to a same scan line, the switch connected between an intermediate node between two transistor devices selected from the plurality of transistor devices configuring the write transistor and a potential; and a drive circuit section configured to drive each of the pixels of the pixel array section, wherein, a potential of the intermediate node between the two transistor devices selected from the plurality of transistor devices configuring the write transistor is placed at the potential which is an intermediate potential between a potential of the signal line and a potential of the gate electrode of the drive transistor by operation of the switch after completion of signal writing by the write transistor during light emission by the light-emitting electro-optical device.

* * * * *